United States Patent [19]

Meatto et al.

[11] Patent Number: 4,545,597

[45] Date of Patent: Oct. 8, 1985

[54] REINFORCING RIBS IN A SNOW SKI WITH A WOOD/FOAM CORE

[75] Inventors: Franklin D. Meatto, Cromwell; Edward D. Pilpel, Manchester, both of Conn.

[73] Assignee: Olin Corporation, Cheshire, Conn.

[21] Appl. No.: 621,758

[22] Filed: Jun. 18, 1984

Related U.S. Application Data

[63] Continuation-in-part of Ser. No. 318,190, Nov. 4, 1981, Pat. No. 4,455,037.

[51] Int. Cl.[4] ..... A63C 5/12

[52] U.S. Cl. ..... 280/610

[58] Field of Search ..... 280/601, 602, 609, 610; 428/545

[56] References Cited

U.S. PATENT DOCUMENTS

| | | | |
|---|---|---|---|
| 3,132,874 | 5/1964 | Baudou | 280/11.13 |
| 3,208,761 | 9/1965 | Sullivan et al. | 280/11.13 |
| 3,272,522 | 9/1966 | Kennedy, III | 280/11.13 |
| 3,276,784 | 10/1966 | Anderson, Jr. | 280/11.13 |
| 3,355,183 | 11/1967 | Kneissl | 280/11.13 |
| 3,503,621 | 3/1970 | Schmidt et al. | 280/11.13 |
| 3,635,482 | 1/1972 | Holman | 280/11.13 L |
| 3,816,573 | 6/1974 | Hashimoto et al. | 264/45 |
| 3,844,576 | 10/1974 | Schultes | 280/11.13 L |
| 3,894,745 | 7/1975 | Heim et al. | 280/11.13 L |
| 3,902,732 | 9/1975 | Fosha, Jr. et al. | 280/11.13 L |
| 3,918,731 | 11/1975 | Legrand | 280/11.13 L |
| 3,933,362 | 1/1976 | Sakuma | 280/11.13 L |
| 3,940,157 | 2/1976 | Sakuma | 280/11.13 L |
| 3,967,992 | 7/1976 | McCaskey, Jr. et al. | 280/11.13 |
| 4,007,946 | 2/1977 | Sarver | 280/600 |
| 4,093,268 | 6/1978 | Sampson et al. | 280/610 |
| 4,094,528 | 6/1978 | Cluzel | 280/610 |
| 4,135,732 | 1/1979 | Magnus | 280/610 |
| 4,146,251 | 3/1979 | Tanahashi | 280/610 |

FOREIGN PATENT DOCUMENTS

| | | | |
|---|---|---|---|
| 917688 | 12/1972 | Canada | 273/65 |
| 2237165 | 7/1972 | Fed. Rep. of Germany . | |
| 2128826 | 12/1972 | Fed. Rep. of Germany . | |
| 1467183 | 1/1967 | France | 280/610 |
| 631879 | 11/1949 | United Kingdom | 280/610 |

*Primary Examiner*—Joseph F. Peters, Jr.
*Assistant Examiner*—Michael Mar
*Attorney, Agent, or Firm*—Ralph D'Alessandro; Donald F. Clements; Thomas P. O'Day

[57] ABSTRACT

In a downhill snow ski there are provided reinforcement rib members which are positioned generally perpendicularly to the top surface and the bottom running surface of the ski and are formed from a material of relatively high modulus with respect to the modulus of the core material formed from wood and foam to impart an increased rate of return and a controllably designed natural frequency to the ski.

15 Claims, 5 Drawing Figures

REINFORCING RIBS IN A SNOW SKI WITH A WOOD/FOAM CORE

BACKGROUND OF THE INVENTION

This is a continuation-in-part application of application U.S. Ser. No. 318,190, now U.S. Pat. No. 4,455,037, filed Nov. 4, 1981 and assigned to the assignee of the present invention.

This invention relates to a ski structure, and more specifically, it is concerned with isotropic reinforcement rib members which extend between the top surface and the opposing bottom or running surface of the ski which permit two primary ski characteristics to be controllably increased dependent upon the type and quantity of reinforcement material utilized.

The continued popularity of downhill skiing has focused attention on the structure of skis to produce a ski that provides greater responsiveness to the improved skiing techniques being employed by skiers today and the increased speed being achieved as a result of these techniques. This continued popularity has caused the materials used in skis to be changed in the efforts to develop higher performance skis at lower manufacturing costs. Skis have been made solely from wood, composite wood-plastic materials, as well as entirely from plastics. Skis made entirely from metal have also been manufactured, as well as incorporating metal into composite wood-plastic skis or into all plastic skis. In particular, the advent of high performance wood-fiberglass and fiberglass-plastic foam skis has intensified the skiing industry's efforts to solve the problem of providing a ski constructed of quality materials which provides increased ski return rates, increased designable natural frequency, increased designable torsional rigidity, and a bottom steel running edge with increased impact resistance.

Different approaches have been taken in an attempt to solve these problems as higher performance skis have evolved in the ski industry. Initially, skis were made with just a wooden core. For some time, a core made of plastic materials, such as plastic foam or urethane, placed within a honeycomb structure formed from aluminum, has been employed. However, because of the higher performance nature of today's skis, these composite skis are subjected to greater flexibility strains which the aforementioned constructions have either failed to withstand or have provided skis which produce a dead sensation to the user. None of the aforementioned structures have provided skis which balance the considerations of high material costs, difficulty in contouring the skis during manufacture and other problems and inefficiencies that occur during the molding and assembly processes employed in the manufacture of snow skis today.

Additionally, to date the prior art ski designs have been ineffective at designing center spring ski constants comparable to those obtained in the hiqh performance racing skis into the recreational skis of preselected lengths used by the general public while increasing the rate of return or snap. Recreational skis typically have been characterized as soft or flexible because they enabled skiers to make turns at relatively slow speeds. The stiff or non-flexible skis, typically utilized for alpine racing, are more difficult to get into a turn at the slower speeds normally achieved by recreational skiers. An increased rate of return or snap in a ski facilitates recovering from a turn. Thus, the optimum design for a recreational ski is one that is soft or flexible with a high rate of return that permits a recreational skier to initiate a turn at a relatively low speed by virtue of the ski's designed flexibility, but which also imparts a livelier feel to the skier and helps the ski recover from the turn because of a designably increased rate of return or snap comparable to that found in racing skis of greater stiffness and higher center spring constants.

The foregoing problems are solved in the design of the present invention by providing structure in a snow ski which creates an increased rate of return and a more lively feel at a lower overall spring constant to provide a quicker responding ski or one that provides a faster change in turning direction.

SUMMARY OF THE INVENTION

It is an object of the present invention to provide in a downhill snow ski high modulus reinforcement members that are incorporated into a relatively low modulus wood and foam core to improve the performance characteristics of the ski.

It is another object of the present invention to provide a downhill snow ski structure that possesses a designably increased rate of return or snap and a more lively feel that is imparted to the skier at a lower overall center spring constant.

It is a further object of the present invention to provide an improved snow ski structure that increases the ski's designable natural frequency, designable torsional rigidity, and bottom steel edge impact resistance.

It is a feature of the present invention to provide at least a pair of reinforcing rib members made from a predetermined high modulus material in comparison to a relatively low modulus wood and foam core, the rib members extending between the top surface and the bottom running surface of the ski which enhances the performance characteristics of the ski.

It is another feature of the present invention to provide reinforcing rib members that offer increased resistance to the bottom steel edges being displaced from the ski body due to impact loading during use.

It is an advantage of the present invention that the improved ski structure provides a quicker responding ski or a ski that provides a faster change in ski turning direction.

It is another advantage of the present invention that the improved ski structure provides a softer flexing, livelier high performance ski.

It is a further advantage of the present invention that the improved ski structure imparts increased torsional rigidity to the ski.

It is yet another advantage of the present invention that the improved ski structure provides a soft flexing ski with a high return rate which possesses increased carving and holding characteristics across a snow or ice surface due to its increased torsional rigidity tuned in concert with the longitudinal flex.

These and other objects, features and advantages are obtained by providing in a snow ski reinforcing rib members positioned generally perpendicularly to the top surface and the bottom running surface of the ski and interiorly of the two opposing sides, the reinforcing rib members being formed from a material of relatively high Young's modulus in flexure with respect to the modulus in flexure of the wood/foam core material so that a designably increased rate of return and a controllably designed natural frequency is imparted to the ski.

BRIEF DESCRIPTION OF THE DRAWINGS

The advantages of this invention will become apparent upon consideration of the following detailed disclosure of the invention, especially when it is taken in conjunction with the drawings wherein.

DETAILED DESCRIPTION

Figure 1:
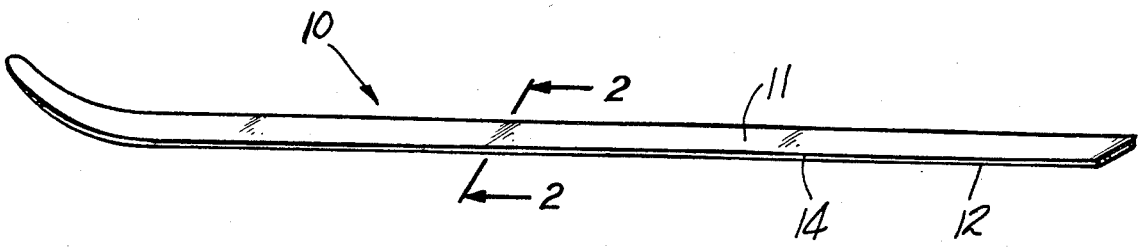
FIG. 1 is a side perspective view of a snow ski incorporating the structure of the present invention.

Referring to FIG. 1 there is seen in side perspective view a ski 10 having a top surface 11, a bottom surface 12 and two opposing side surfaces 14 (only one of which is shown).

Figure 2:
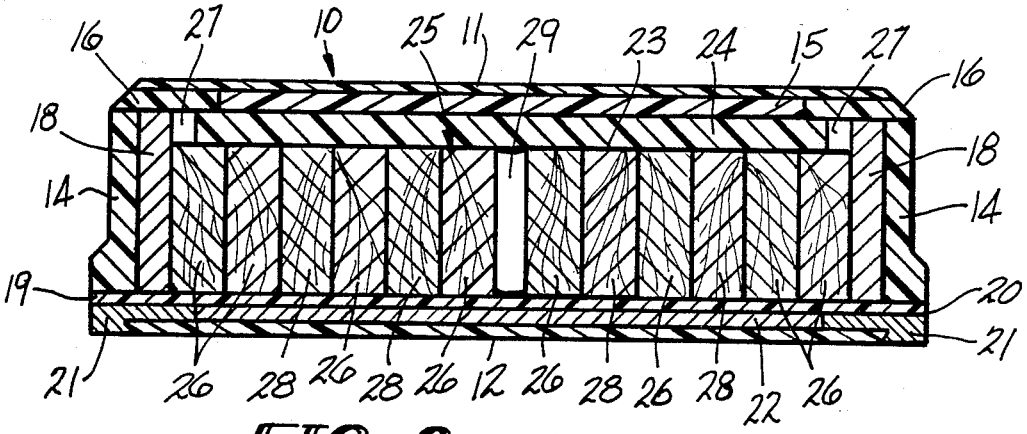
FIG. 2 is a sectional view taken along the line 2—2 of FIG. 1 showing the improved ski structure of the present invention.

FIG. 2 shows in a sectional view the structure of the invention. The top surface 11 is a sheet or layer of acrylonitrile butadiene styrene (ABS). Beneath the top surface 11 in the central portion of the ski 10 is a layer of unidirectional fiberglass 15 of predetermined thickness. Adjacent this unidirectional fiberglass layer 15 on both peripheral edges are the plastic top edges 16 that run the entire length of the ski. The use of plastic in the top edges 16, as opposed to a metal in a solid bottom edged ski, such as aluminum, serves to reduce the strain in the bottom edges 21 for the same implied load. Adjacent to each of the opposing sides 14 are perpendicularly extending reinforcement rib members 18 that run from the plastic top edges 16 to the bottom layer of unidirectional fiberglass 19. The opposing sides 14 are comprised of ABS and serve to protect the reinforcement rib members 18 as well as to form an outer surface of the ski. The bottom layer of unidirectional fiberglass 19 also serves to provide stiffness to the ski. Beneath this layer 19 is a layer of rubber foil 20 that extends across the entire width of the ski. The rubber foil layer 20 helps bond the steel bottom edges 21 to the opposing sides 14 and the rib members 18, as well as helping to control the vibrations within the ski 10 during use.

Bottom edges 21 beneath the rubber foil layer 20 may be either a solid edge or a cracked edge as desired. It is known that a solid edge imparts more vibration to the ski, keeping all other design factors constant, and permits the surface tension between the bottom surface 12 and the snow to be broken. If the bottom edges 21 are cracked, as is well known in the art, less vibration is transmitted to the ski.

Interiorly of the bottom edges 21 is an inner bottom layer 22 formed of either polyethylene or aluminum. Where aluminum is used, such as in a giant slalom ski, the vibrational characteristics of the ski are enhanced by increasing the natural frequency of the ski. In this type of a ski, it is desirable to break up the surface tension or water suction between the bottom running surface 12 of the ski and the snow. The polyethylene is used as a filler in this inner bottom layer where a higher natural frequency is not needed. The bottom surface 12 of the ski 10 is comprised of polyethylene and forms the major contact surface with the snow.

Looking again at the top surface of the ski 10, there is seen a layer 24 beneath the unidirectional fiberglass layer 15 which is formed of polyester and random fiberglass in the binding plate area. This is utilized only in the binding plate area to add screw retention strength of the ski when the bindings are mounted. Outside the binding area this layer is replaced by the wood of the core, indicated generally by the numeral 25. Beneath the layer 24 of polyester and random fiberglass in the binding plate area is a layer of binding foil 23. This binding foil layer 23 compensates for any mismatched tolerances in the wood core 25, as well as its principal purpose of increasing the binding pull out strength. The binding foil layer 23 may be made from any suitabe elastomeric material, although rubber or ionomer are preferred. When compressed under the pressure of a press, the rubber or ionomer acts as a film adhesive that helps to bond layer 24 to the core 25. Adjacent the layer 24 of polyester and random fiberglass and between the rib members 18 on opposing sides are air spaces 27. These spaces are also only found in the binding plate area.

The core 25 is formed from a plurality of layers of aspen and birch which are laminated together so that the layers are generally perpendicular to the top surface 11 and the bottom surface 12. On the outermost portion of the core adjacent the rib members 18 are two adjacently positioned layers of aspen 26 that are laminated together by an appropriate adhesive. Adjacent these layers of aspen is a layer of birch 28. In alternating sequence, subsequent layers of aspen, birch, and aspen are also laminated together. Separating the two interior aspen layers 26 of the wood core 25 is a wedge space 29 that is narrow in the center of the ski but widens as the opposing ends of the ski 10 are approached. Wedge space 29 is hollow air space into which are emplaced approximately three wedges (not shown) so that the core sticks or alternating layers of birch and aspen can be bent or formed during manufacture of the ski to conform to the side cut or geometry of the ski. It is this side cut or geometry plus the flexural pattern of the ski which defines the turning radius of a ski.

Figure 3:
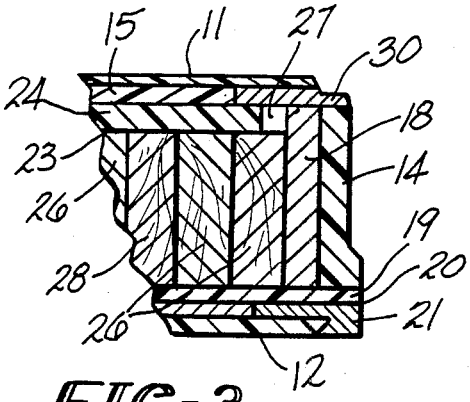
FIG. 3 is a partial sectional view showing an alternative embodiment of the top edges employed in the ski of the present invention.

FIG. 3 shows in a partial view an alternative design that may be employed with the top edges. The structure previously described has added thereto top edges 30 (only one of which is shown). Top edge 30 has routing along its exterior and top surface 11, as opposed to the smoothly tapered design shown in FIG. 2. Additionally, the top edges 30 may be formed from aluminum.

Figure 4:
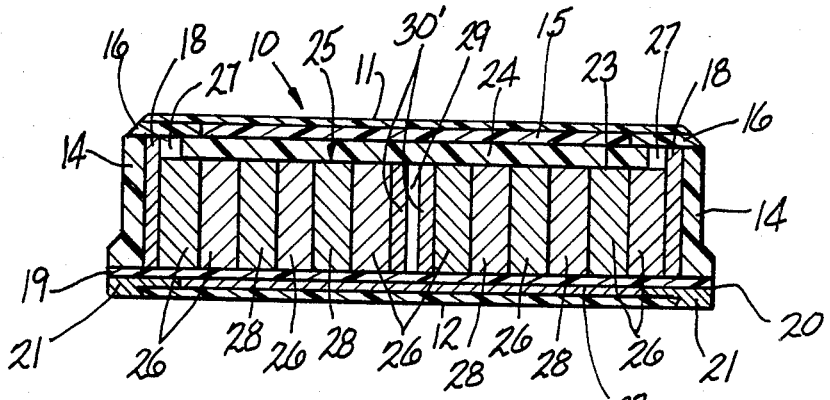
FIG. 4 is a sectional view showing an alternative embodiment of the improved ski structure of the present invention.

FIG. 4 shows an alternative embodiment employing two sets of rib members, exteriorly positioned rib members 18 and a second set of interiorly positioned rib members 30'. The interiorly positioned rib members 30' are placed on opposing sides of the wedge space 29 and further enhance the ski return rate and torsional reinforcement.

Figure 5:
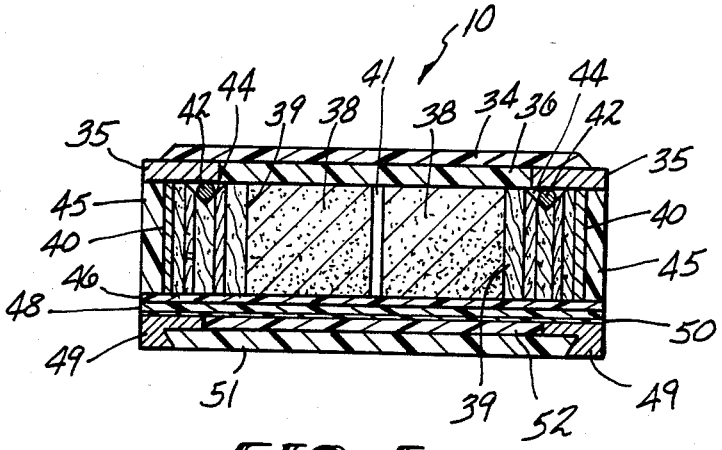
FIG. 5 is a sectional view taken along the same section lines as section 2—2 of FIG. 1 showing another alternative embodiment of the improved ski structure of the present invention using a wood/foam core with graphite reinforcing rods.

The cross-sectional configuration of the embodiment of the ski 10 employing a wood/foam core is best shown in FIG. 5. Ski 10 is shown as having a top surface 34 which overlies the top edges 35 and the compression carrying laminate layer 36. The core of the ski 10 is formed from a combination of a polyurethane core portion 38 and a wood portion 39. Reinforcement rib members 40 are shown positioned exteriorly of the wood portion 39 of the core on each side of the ski 10. A wedge space 41 is seen separating the two polyurethane core portions 38. Fiber reinforcing means 42, when included in the design, are at least partially embedded in a machined slot 44 in the wood core portions 39. Sidewalls 45 protect the sides of the skis and are positioned generally vertically adjacent the reinforcing ribs 40 on the opposing first and second sides of the ski. Underlying the core portions 38 and 39, the rib members 40, and the sidewalls 45 is a torsional stiffness reinforcing layer 46. Beneath the torsional stiffness reinforcing layer 46 is a tensile carrying or main facing laminate layer 48. Along the first and second sides of the cross-section of the ski 10 along the axial length are the bottom edges 49. Above the bottom edges 49 and beneath the main facing laminate layer 48 is a bottom foil layer 50. A bottom running surface 51 underlies the thermal balance layer 52 and and second sides or sidewalls 45 of the ski 10. lies between the bottom edges 49 and the opposing first Fiber reinforcing means 42 may be located with respect to the cross-section of the ski 10 on the compression side or in the compression portion of the sandwich structure of the ski 10, which positions them above the neutral axis of the ski beam. This permits the fiber reinforcing means 42 to be positioned above or below the compression carrying laminate layer 36, as desired.

The fiber reinforcing means 42 may be pretested for physical properties prior to inclusion into the sandwich structure of the ski 10 to ensure that these desired physical properties may be reliably reproduced within design tolerances in skis during the manufacturing process. Tests are conducted for flexural strength and modulus of elasticity in flexure, adhesive bond strength in shear and, where graphite is employed, graphite fiber percent composition by weight of the fiber reinforcing means. Thus, the physical properties of fiber reinforcing means 42 are determined independently of the final laminated ski sandwich structure.

It should be noted that the rib members 18 and 30 may be formed either from graphite, aluminum, aramid, boron or other appropriate material. The key consideration is forming the ribs from a high modulus material incorporated into a relatively low modulus wood core to develop a ski with an increased return or snap and a more lively feel at lower overall center spring constant to create a quicker responding ski or a ski that provides faster changes in turning direction.

This result is achieved because of the relationship between Young's modulus of flexure for the materials employed where conditions are such that the constant of proportionality of flexure or elasticity may be described by the equation $E=6/E$. Thus, as envisioned by the present invention a wood core is known to have a Young's modulus of elasticity of about $1\times10^6$ pounds per square inch (psi). Graphite in a composite has a Young's modulus of elasticity of about $20.4\times10^6$ psi, while aluminum's is about $10.4\times10^6$ psi. Thus the operable range for the ratio of the modulus of the reinforcement rib to the core is from about 25 to 1 to about 8 to 1, while the preferred range is from about 12 to 1 to about 9 to 1. The optimum material has a high Young's modulus of elasticity to density ratio where the density of the materials as employed approximately are 0.40 for wood, 1.30 for composite graphite and 2.61 for aluminum.

Different foams may be employed in the wood/foam core. The preferred is a polyurethane foam that may have a density which can range from about 8 pounds per cubic foot to about 37.44 pounds per cubic foot, depending upon the commercial source. Generally the higher the density, the lower will be the modulus of elasticity to density ratio. For example, with 8 pounds per cubic foot polyurethane foam the modulus of elasticity to density ratio is about $70\times10^6$ (pounds per inch$^2$)(psi/pci), while with 25 pounds per cubic foot (pounds per inch$^3$) polyurethane foam the same ratio is about $54\times10^6$ psi/pci and with 37.44 pounds per cubic foot polyurethane foam the same ratio drops to about $45\times10^6$ psi/pci.

Alternatively, a polymethacrylimide foam, such as that sold under the tradename ROHACELL, can be employed with a density of about 4.4 pounds per cubic foot. This type of foam gives a modulus of elasticity to density ratio of about $75\times10^6$ psi/pci.

The center spring constants of the skis of the present design have been found to be from about 18 pounds per inch to about 21 pounds per inch for skis ranging from about 190 centimeters to about 205 centimeters in length. These center spring constants were measured by a 500 pound capacity load cell connected to a Doric transducer having a digital readout in conjunction with a direct current driven Saginaw gear predetermined displacement force device. The predetermined displacement employed was about one inch.

The increased bottom steel edge impact resistance achieved by the design of the reinforcing rib members provides a ski of greater durability. This results from impact energy being transmitted through the bottom edges 21 or 49 and the layer 19 of unidirectional fiberglass, or the layers 46, 48 and 50 of FIG. 5 to the reinforcing ribs. The compressive impact energy is then dissipated along the length of the reinforcing rib, which extends along the entire snow contact surface of the ski. This results in the dispersion of the impact stress concentration to prolong the life of the bottom steel edges 21 or 29 and the bottom surface 12 or 51.

It should also be noted that the rib reinforcing members can be bonded to the other core components prior to ski molding or during the molding process in the production of the ski. This construction technique has been applied to a laminated construction, but can also be used in a wet wrap or injection molded production process.

While the preferred structure in which the principles of the present invention have been incorporated is shown and described above, it is to be understood that the invention is not to be limited to the particular details thus presented but, in fact, widely different means may be employed in the practice of the broader aspects of this invention. The scope of the appended claims is intended to encompass all obvious changes in the details, materials and arrangements of parts that will occur to one of ordinary skill in the art upon a reading of this disclosure.

Having thus described the invention, what is claimed is:

1. In a snow ski of predetermined length having a composite core with a wood portion and a foam portion of known modulus of elasticity, the snow ski having a top surface, a bottom running surface bounded to its opposing sides by metal edges and two opposing sides positioned generally perpendicularly to the top and bottom surfaces and intermediate thereof, the improvement comprising in combination:

a the composite core having the foam portion interiorly of the wood portion, the wood portion having a longitudinally extending slot in which is embedded fiber reinforcing means; and b. at least two reinforcing rib members positioned generally perpendicularly and connected to the top and bottom surfaces interiorly of the two opposing sides adjacent the wood portion of the composite core, the reinforcing rib members being formed from aluminum with a relatively high modulus of elasticity in comparison to the composite core giving a high ratio of the modulus of elasticity for the combined material of the reinforcing rib members and the composite core to the density for the combined material of the reinforcing rib members and the composite core so that an increased rate of return and a controllably designed natural frequency is imparted to the ski.

2. The apparatus according to claim 1 wherein the reinforcing rib members are positioned between the composite core and the two opposing sides.

3. The apparatus according to claim 1 wherein the composite core has a predetermined width with an wedge space extending substantially the predetermined length of the ski to divide the predetermined width of the composite core equally into two parts.

4. The apparatus according to claim 3 further comprising two additional reinforcing rib members, one each being positioned on each side of the wedge space and extending generally perpendicularly to the top surface and the bottom running surface.

5. The apparatus according to claim 4 wherein the two additional reinforcing members are formed from aluminum.

6. The apparatus according to claim 1 wherein the ratio of the modulus of elasticity of the material of the reinforcing rib members to the composite core material is greater than about 8 to 1.

7. The apparatus according to claim 1 wherein the foam core is a polyurethane foam.

8. In a snow ski of predetermined length having in combination:

a. a top surface;

b. a bottom running surface with two opposing sides and bounded thereon by bottom metal edges extending the predetermined length of the ski;

c. two opposing sides positioned generally perpendicularly to the top surface and the bottom running surface;

d. a composite core of predetermined width formed from a wood portion and a foam portion of known modulus of elasticity positioned centrally between the two opposing sides, the wood portion being exteriorly of the foam portion and having a longitudinally extending slot therein in which is embedded fiber reinforcing means;

e. top edges formed from a predetermined material at least partially beneath the top surface adjacent and above the two opposing sides extending substantially the predetermined length of the ski;

f. a layer of material of predetermined selection at least partially above the bottom metal edges and of predetermined thickness;

g. a layer of bonding material between the layer of material of predetermined selection and the bottom metal edges; and h. at least two reinforcing rib members positioned exteriorly of the composite core adjacent the wood portion and adjacent and interiorly of the two opposing sides extending a distance less than the predetermined length of the ski connected on a first end to the top edges and on a second end to the layer of material of predetermined selection, the reinforcing rib members further being positioned generally vertically to the top surface and the bottom running surface and being formed from aluminum of predetermined thickness with a known modulus of elasticity that is relatively high in comparison to the modulus of elasticity of the composite core to impart an increased rate of return and controllably designed natural frequency to the ski.

9. The apparatus according to claim 8 wherein the composite core has a wedge space extending substantially the predetermined length of the ski to divide the predetermined width of the composite core equally into two parts.

10. The apparatus according to claim 9 further comprising two additional reinforcing rib members, one each being positioned on each side of the wedge space and extending generally perpendicularly to the top surface and the bottom running surface.

11. The apparatus according to claim 10 wherein the two additional reinforcing members are formed from aluminum.

12. The apparatus according to claim 8 wherein the top edges are formed from a plastic material.

13. The apparatus according to claim 12 wherein the layer of material of predetermined selection is comprised of unidirectional fiberglass.

14. The apparatus according to claim 8 wherein the ratio of the modulus of elasticity of the material of the reinforcing rib members to the composite core material is greater than about 8 to 1.

15. The apparatus according to claim 8 wherein the foam portion is a polyurethane foam.

* * * * *

UNITED STATES PATENT AND TRADEMARK OFFICE

CERTIFICATE OF CORRECTION

PATENT NO. : 4,545,597

DATED : October 8, 1985

INVENTOR(S) : Franklin D. Meatto and Edward D. Pilpel

It is certified that error appears in the above-identified patent and that said Letters Patent is hereby corrected as shown below:

In column 5, at lines 18-20 please delete "and (second occurrence) second sides or sidewalls 45 of the ski 10. lies between the bottom edges 49 and the opposing first" and insert --lies between the bottom edges 49 and the opposing first and second sides or sidewalls 45 of the ski 10--.

In column 5, at line 53 please delete "E = 6/E" and insert --$E = \frac{\sigma}{\varepsilon}$--.

In column 6, at lines 7-9 please delete "pounds per inch$^2$)(psi/pci), while with 25 pounds per cubic foot (pounds per inch$^3$)" and insert --$\frac{\text{pounds per inch}^2}{\text{pounds per inch}^3}$ (psi/pci), while with 25 pounds per cubic foot--.

Signed and Sealed this

Fourteenth Day of January 1986

[SEAL]

Attest:

DONALD J. QUIGG

Attesting Officer

Commissioner of Patents and Trademarks